US005087097A

United States Patent [19]

Hehn

[11] Patent Number: 5,087,097

[45] Date of Patent: Feb. 11, 1992

[54] HIGH CHAIR TRAY ATTACHMENT

[76] Inventor: Bruce A. Hehn, 9570 Pondera St., NW., Massillon, Ohio 44646

[21] Appl. No.: 612,627

[22] Filed: Nov. 14, 1990

[51] Int. Cl.[5] ..... A47B 83/02

[52] U.S. Cl. ..... 297/153; 297/149

[58] Field of Search ..... 297/153, 148, 149, 150, 297/154, 174

[56] References Cited

U.S. PATENT DOCUMENTS

| | | | |
|---|---|---|---|
| 3,383,134 | 5/1968 | Webb | 297/153 |
| 3,511,531 | 5/1970 | Benoit et al. | 297/153 |
| 3,632,163 | 1/1972 | Burnham | 297/153 X |
| 4,105,297 | 8/1978 | Saint | 297/149 |
| 4,288,123 | 9/1981 | Cone | 297/154 |
| 4,582,359 | 4/1986 | Wise et al. | 297/153 X |

*Primary Examiner*—Laurie K. Cranmer

*Attorney, Agent, or Firm*—Renner, Kenner, Greive, Bobak, Taylor & Weber

[57] ABSTRACT

A detachable tray apparatus (20, 120) for a high chair (21) having a pair of spaced arm rails (30, 31) including, a tray body (40, 40') providing a substantially planar surface (41) spanning the distance between the pair of spaced upper arm rails, and a pair of spaced attachment mechanisms (50, 50; 150, 150) affixed to the tray body and selectively engaging the arm rails, each of the attachment mechanisms having a gripper (50, 50) movable from an open position into engagement with a portion of the periphery of an arm rail for maintaining the tray in a locked position. Impact absorbers (90, 190) may be provided on the tray for engaging the arm rails to resist lateral forces applied to the tray.

16 Claims, 5 Drawing Sheets

HIGH CHAIR TRAY ATTACHMENT

TECHNICAL FIELD

The present invention relates generally to a tray attachment for high chairs. More particularly, the present invention relates to a tray attachment for high chairs which can be readily attached to and detached from the high chair. More specifically, the present invention relates to a tray attachment for high chairs which has mechanism for effecting locking attachment of the tray to the side rails of a high chair and selective controlled detachment therefrom.

BACKGROUND ART

Seating devices designed expressly for infants and relatively small children have been known for many years. One type of such seating devices are termed "high chairs", which are so named because they are sufficiently elevated from the floor such that an infant positioned in a high chair has his or her head at a level comparable to that of an adult seated in a conventional chair, despite the child's very much shorter body trunk length. High chairs are normally characterized by four relatively long upright legs which are joined and cross-braced in various manners to provide an elevated seat as compared with a conventional chair. Characteristically, high chairs have a back and frequently side rails and a front rail to prevent an infant from jumping or accidently toppling from the high chair at its somewhat elevated height which could pose a threat to a child's safety.

A similar type of seating device often employed for children slightly older than those using high chairs are booster seats. Booster seats are a device which is adapted to be positioned in a conventional chair for adults and having short upward supports which position the seating surface of the booster seat elevated a distance above the seating surface of the chair. In a manner similar to high chairs, booster seats frequently have a back, side rails and perhaps a front rail or other type of restraining device to assist in maintaining the child in the booster seat. In some instances in both booster seats and high chairs, various types of auxiliary straps may be employed to assure that the infant or small child cannot intentionally or accidentally slide or topple from the chair with the attendant possibility of bodily injury.

Some types of high chairs and booster seats as aforedescribed are used merely as an infant seating device. More commonly, however, these devices are designed to be used primarily, or at least secondarily, as a seating device when children are fed. In the aforedescribed high chair and booster seat configuration, the high chair or the chair on which a booster seat is placed are merely moved into close proximity to a table or other eating surface. Perhaps more commonly, particularly in regard to high chairs, a tray is provided to be supported by the side rails and in some instances, a front rail of the high chair to place the tray in close proximity to the child. In such instances, the tray may serve as a front retaining member to preclude the child from sliding or falling forward out of the chair. Over the years, a great number of tray attachments have been designed for both high chairs and booster seats. In some instances, the tray attachments are permanently affixed to the high chair, while in other instances, they have been removable. In order to permit the tray attachment to be displaced from the eating position to facilitate the ingress and egress of a child into and out of a high chair, some trays have been pivoted on a pair of extending arms hinged at the rear of the chair and capable of being moved from an eating position to a storage position by movement through a large arc from a horizontal position to a substantially vertical position down the rear of the high chair. Tray attachments of this nature have the disadvantage that they normally are not detachable for washing or cleaning. In some instances, metallic or plastic inserts have been provided for these trays; however, the problem then arises as to how to maintain the insert in place so it cannot be displaced by the child while allowing removal for cleaning. Further, solving these problems, together with the arms for pivoting the tray attachment have resulted in a complex, cumbersome and relatively expensive configuration.

One type of high chair tray attachment has employed a ring encircling one rail at one lateral extremity of the tray for sliding movement longitudinally of the one rail and pivoting from a horizontal position spanning the rails to a vertical position alongside the one rail. The other lateral extremity of the tray may or may not have a track or other attachment affixed to the other rail to which a tray attachment interfits for effecting locking of the tray at various locations longitudinally of the rails. A primary disadvantage of this type of tray attachment is that the tray cannot be separated from the high chair for cleaning without dismantling the ring assembly.

In other instances, high chair tray attachments have been designed to operate with a high chair having specially configured rails or a track or other attachment affixed to both rails to which a tray attachment interfits. These configurations tend to become relatively complex in order to provide for adjustment of the tray attachment longitudinally of the arms of the high chair and even more complex in endeavoring to provide for selective detachment and attachment of the tray on the arms. In instances where there is an excess amount of operating mechanism, the possibility of pinching or other injury to the occupant of the high chair or a person endeavoring to operate the tray attachment may arise. In addition, many of these units operate in a manner such that the tray attachment may undesirably be adjusted or removed by a child in the high chair. A wide variety of high chair tray attachments have been developed without success in trying to solve the various problems attendant these devices and overcoming all the disadvantages thereof.

DISCLOSURE OF THE INVENTION

Therefore, an object of the present invention is to provide a detachable tray for high chairs or the like which may be attached to, detached from, and adjusted longitudinally of the side rails of a high chair. Another object of the present invention is to provide such a tray which may be employed with standard high chairs that have been and are currently on the market or which may be readily adapted by dimensional variations to high chairs having side rails of different spacing or differing cross-sectional configurations. Still another object of the invention is to provide such a tray which eliminates many of the disadvantages of tray attachments for high chairs which have been employed over the years.

Another object of the present invention is to provide a detachable tray for a high chair or the like having attachment means which snaps onto the side rails of a high chair to effect locking thereto upon the application of a downward pressure on the top of the tray. A further object of the present invention is to provide such a tray which can be removed only by the release of a projecting lever arm accompanied by upward pressure so that the tray snaps out of its locked position, thereby precluding accidental removal of the tray. Yet another object of the present invention is to provide such a tray having grippers which pivot between a locked and unlocked position as the tray is moved vertically relative to the side rails of the high chair. Still a further object of the invention is to provide such a tray wherein the grippers are biased toward the release position when not engaged by the chair side rails such that the grippers act as angular guides to align the tray relative to the chair rails for attachment thereto, without the necessity for attempting to view the location of the side rails and endeavoring to achieve unassisted alignment. Another object of the present invention is to provide such a tray wherein the lateral location of the grippers of the attachment mechanism is automatically adjusted to accommodate variations in the size and spacing of the side rails of a particular design of high chair.

Still another object of the present invention is to provide a detachable tray for a high chair or the like which may be adjusted front to back relative to the siderails of a chair by the application of pressure and which permits such adjustment only upon slight engagement of the release arms, or which absolutely precludes tray sliding unless the release levers are engaged to effect detachment of the tray from the side rails. Yet another object of the invention is to provide such a tray having an attaching mechanism which may be locked onto a wall-mounted bar similar to one of the side rails or other comparable configuration to effect wall-mounted storage of the detachable tray when not in use.

Still a further object of the present invention is to provide a detachable tray for a high chair or the like which retains the capability of adjusting the position of food or beverages relative to the position of a child in the high chair and may be provided with a ridge or obstruction around the upper perimeter of the tray to effect to an extent the retention of food and articles on the tray. Still another object of the invention is to provide such a tray having a minimum of elements located laterally interiorly of the side rails of the high chair which could inadvertently injure an occupant in the high chair. Yet a further object of the present invention is to provide such a tray with stop bars located laterally of the side rails of the high chair to resist extreme lateral forces which may be applied to the tray.

Still another object of the invention is to provide such a tray without the necessity for internal mechanisms protected by a cover with latches or interlocks extending outwardly thereof such that food or beverages can become lodged internally of the tray where cleaning and sterilization can be difficult to accomplish. Still a further object of the invention is to provide such a tray which is of relatively simple and durable construction, which has primarily plastic components that can be readily assembled or disassembled, which is simple and sure in operation, and which is relatively inexpensive.

In general, the present invention contemplates detachable tray apparatus for a high chair having a pair of spaced upper arm rails including, a tray body providing a substantially planar surface spanning the distance between the pair of spaced upper arm rails, and a pair of spaced attachment mechanisms affixed to the tray body and selectively engaging the arm rails, each of the attachment mechanisms having a gripper movable from an open position into engagement with a portion of the periphery of an arm rail for maintaining the tray in a locked position. Impact absorbers may be provided on the tray for engaging the arm rails to resist lateral forces applied to the tray.

PREFERRED EMBODIMENT FOR CARRYING OUT THE INVENTION

Figure 1:
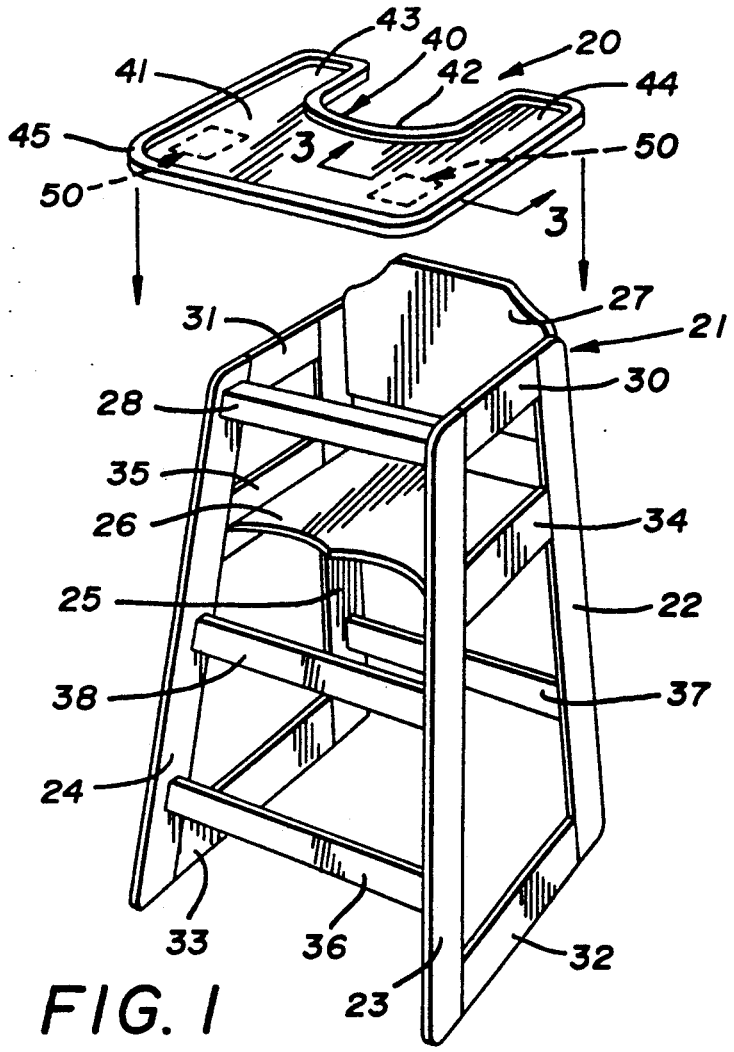
FIG. 1 is a perspective view of the high chair tray attachment according to the concepts of the present invention shown in relation to an exemplary high chair substantially in position for attachment thereto.

Exemplary detachable tray apparatus embodying the concepts of the present invention is generally denoted by the numeral 20 in FIG. 1 of the accompanying drawings. The detachable tray 20 is depicted for exemplary purposes in relation to a high chair, generally indicated by the numeral 21. As shown, the high chair 21 has four spaced, substantially upright legs 22, 23, 24 and 25. The legs 22–25 of the high chair 21 shown herein form a configuration which is essentially a frustum of a pyramid. Proximate to but spaced a distance from the upper extremities of the legs 22–25 is a seat 26 for supporting an infant or child seated in the high chair 21. Extending a distance above the seat 26 and between legs 22 and 25 is a backrest 27, which is preferably of a significant vertical height such as to provide a back support for a child reposing on the seat 26. Displaced from and preferably paralleling the backrest 27 is a front rail 28 extending between the legs 23, 24. The front rail 28 is for purposes of precluding a child from toppling or sliding forwardly off the seat 26, either accidentally or intentionally and, thus, to preclude the attendant possibility of inadvertent injury from a fall.

Figure 3:
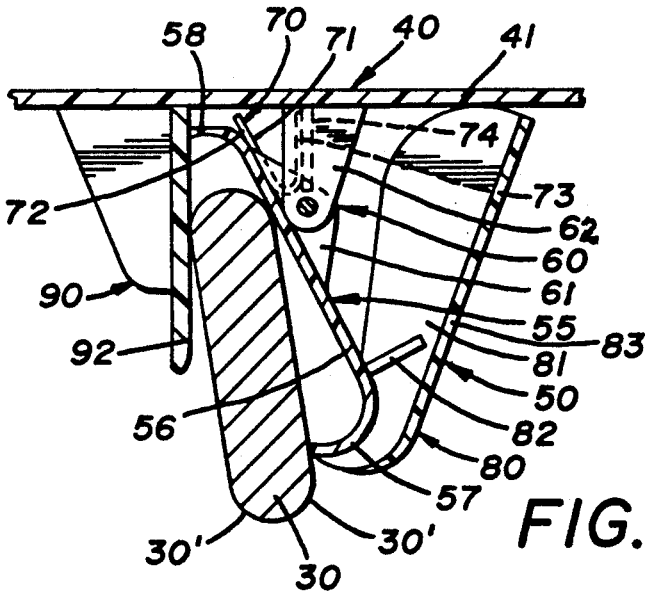
FIG. 3 is a cross-sectional view taken substantially along the line 3—3 of FIG. 1 of a gripper assembly positioned in relation to a side rail of the high chair preparatory to attachment.

Disposed substantially perpendicularly to the backrest 27 and front rail 28 and extending between legs 23 and 24 and legs 24 and 25 are arms or side rails 30 and 31, respectively. As shown, the side rails are generally rectangular with rounded edges 30' as best seen in FIG. 3. Thus, a child positioned in the high chair 21 is generally restrained in all four directions relative to the seat 26.

The pyramidal configuration of legs 22–25 is maintained and rigidified as by lower side braces 32 and 33 and upper side braces 34 and 35. Lateral stability may be imparted to the high chair 21 by a lower front brace 36 and a lower back brace 37 joining the legs 23 and 24 and legs 22 and 25, respectively. In addition, an upper front brace 38 joins the front legs 23 and 24 preferably substantially medially of the longitudinal extent of legs 23 and 24. It will be appreciated that more or less braces and variations in the position of the braces may be provided as is characterized by the variety of high chair designs existing in the marketplace.

It is to be understood that the term "high chair", as employed in the context of the instant application, shall be deemed to include booster seats, which are similarly configured, short legged devices adapted to be positioned on the seat of a conventional chair, as well as other similar seating devices. Such child seating devices have in common elements similar to the seat 26, backrest 27 and a pair of substantially parallel, spaced arms or side rails 30, 31.

The detachable tray 20 as depicted for exemplary purposes in FIG. 1 includes a body portion, generally indicated by the numeral 40. The body portion 40 includes a generally rectangular planar surface 41 which may be employed to support dinnerware, utensils, food and/or beverage containers. As shown, the planar surface 41 has a cutout 42 thereby forming extension surfaces 43 and 44 of planar surface 41 which repose laterally of a child positioned in high chair 21 with detachable tray 20 positioned thereon. The body portion 40 of detachable tray 20 may be provided with a ridge 45 extending around the perimeter of planar surfaces 41, 43 and 44 to preclude articles positioned thereon from accidentally falling from tray 20.

Figure 2:
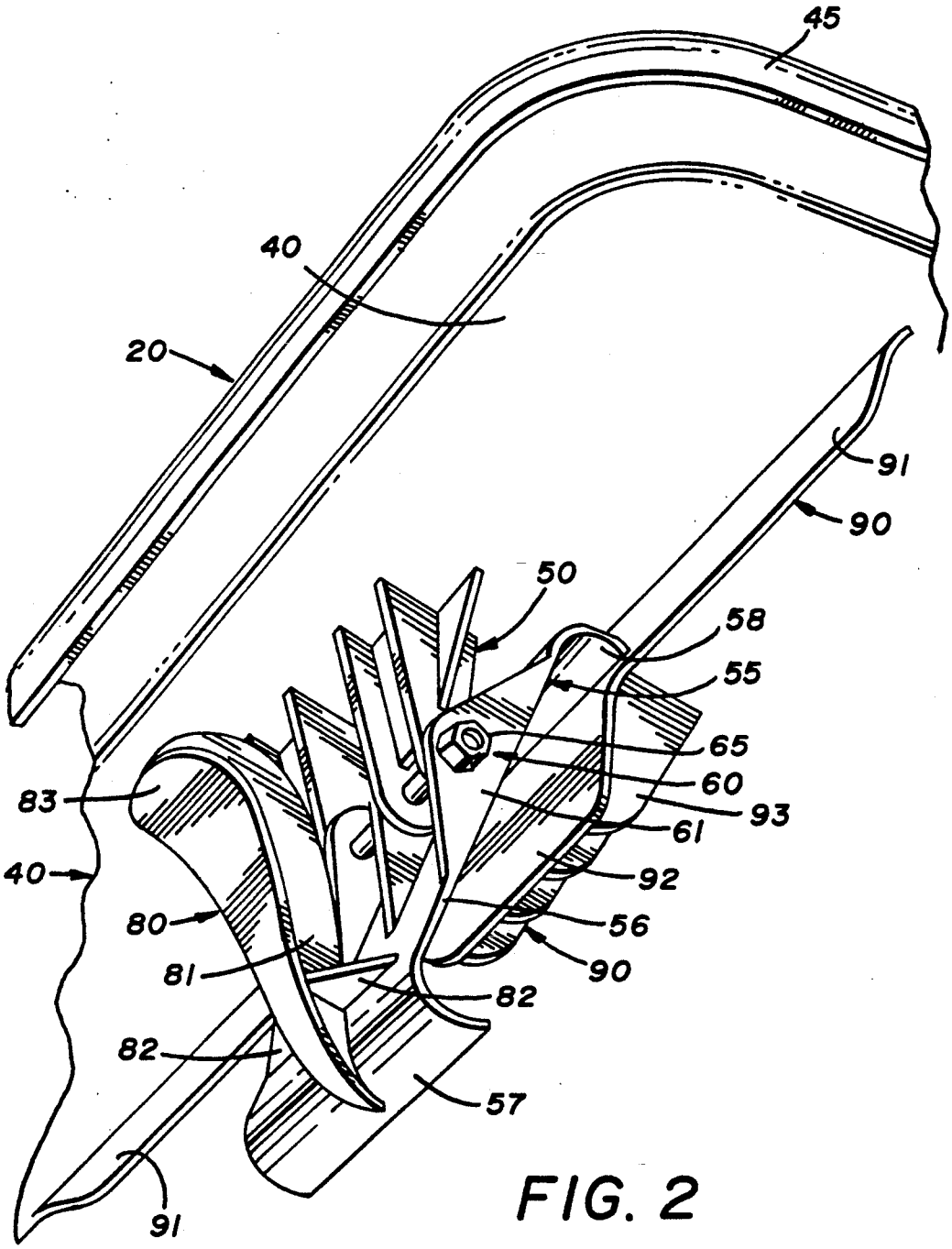
FIG. 2 is a perspective view depicting a fragmentary portion of the bottom of the high chair and tray attachment of FIG. 1 showing details of one of the gripper assemblies.

Referring to FIGS. 1–3 of the drawings, the tray 20 interrelates to the high chair 21 by virtue of a pair of spaced attachment mechanisms 50. The attachment mechanisms 50 are mounted to the underside of planar surface 41 of the body portion 40 of tray 20 in the locations generally depicted in FIG. 1 of the drawings. The left side attachment mechanism when the high chair 21 is viewed from the front is depicted in FIG. 2 of the drawings while the right hand attachment mechanism 50 is seen in FIG. 3. The attachment mechanisms are spaced substantially the distance between side rails 30, 31 of the high chair 21 and preferably located so that the attachment tray 20 and particularly the body portion 40 extends the same distance laterally to either side of the side rails 30, 31.

The attachment mechanisms 50, 50 may be identical and each include a gripper assembly, generally indicated by the numeral 55. Each gripper assembly has an intermediate leg 56 which is shown as preferably substantially linear. Each leg 56 is of a linear extent which is substantially the vertical height of the side rails 30, 31 of the high chair 21 (see FIG. 3). The intermediate legs 56 space and join projecting ends 57 and 58, which extend outwardly a distance such as to overlie at least a portion of the thickness of the side rails 30, 31 of the high chair 21. For purposes of effecting optimum gripping relation between the gripper assemblies 55 and the side rails 30, 31, the projecting ends 57, 58 may be contoured to substantially conform with the configuration of the vertically upper and lower surfaces of side rails 30, 31. For example, as seen in FIG. 3 of the drawings, the projecting ends 57, 58 are curved to conform to the rounded edges 30' of the side rails 30, 31. It will thus be appreciated that the gripper assemblies 55 overlie substantially three surfaces of the side rails 30, 31. At least the intermediate legs 56 are preferably of a material and thickness such as to permit an extent of bending for a purpose hereinafter detailed. In this respect, it has been found that a ⅛ inch thickness of polystyrene or ABS plastic provide examples of appropriate bending characteristics.

The attachment mechanisms 50, 50 have hinge mechanisms, generally indicated by the numeral 60, for pivotally connecting the gripper assemblies 55 to the body portion 40 of tray 20. Referring now to FIGS. 2–9 of the drawings, the hinge mechanisms 60 include movable knuckles 61 which are preferably attached to the side of intermediate legs 56 opposite the surface which overlies the side rails 30, 31. As best seen in FIG. 6, six spaced movable knuckles 61 are depicted in the preferred embodiment of the invention. It is to be appreciated that, dependent upon the width of the intermediate legs 56 of gripper assemblies 55, more or less of the movable knuckles 61 may be provided depending upon the materials employed and other design considerations which will be apparent to persons skilled in the art.

The hinge mechanism 60 also includes a plurality of fixed knuckles 62 which are attached to the underside of the planar surface 41 of body portion 40 of tray 20. The fixed knuckles 62 may be integrally formed, adhesively bonded, or otherwise rigidly affixed depending upon the type of materials employed in a particular construction. In a manner similar to movable knuckles 61, a plurality of fixed knuckles 62 may be employed. Depending upon design considerations, it may be advantageous that there be comparable numbers of fixed knuckles 62 to the number of movable knuckles 61 and that they be arranged to lie in close proximity laterally of the gripper assemblies 55 as exemplified by the arrangement depicted in FIG. 6 of the drawings.

Figure 9:
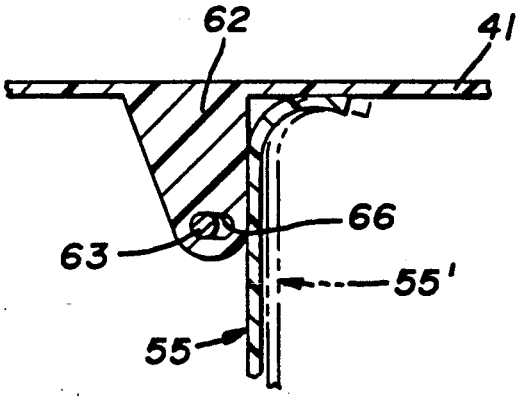
FIG. 9 is a fragmentary sectional view taken substantially along the line 9—9 of FIG. 6 showing details of the fixed knuckle of the hinge.

The fixed knuckles 62 and the movable knuckles 61 are joined in conventional fashion by a pivot pin 63 extending therethrough. The pivot pin 63 is secured in place as by having an enlarged head 64 at one extremity thereof and a push nut 65 at the other extremity thereof (see FIGS. 2 and 6). The fixed knuckles 62 may advantageously have a laterally elongate bore 66 as seen in FIG. 9, in order to provide an extent of lateral adjustment of the gripper assemblies 55, 55 relative to the side rails 30, 31 of the high chair 21. It will be understood that the laterally elongate bore 66 could be in movable knuckles 61, or a laterally elongate bore 66 could be provided in both knuckles 61, 62. The gripper assembly 55 depicted in solid lines in FIG. 9 is shown in its laterally outermost position. The gripper assembly 55 may move laterally inwardly by its attached pivot pin 63 moving in lateral slot 66 to the chain line position 55'. This lateral movement of one or both of the gripper assemblies 55 provides an extent of lateral adjustment of gripper assemblies 55 to accommodate differences in the thickness of the side rails 30, 31 or the lateral spacing therebetween. In addition, this lateral adjustment may facilitate attachment and release of the gripper assemblies 55, 55 to side rails 30, 31 as hereinafter described.

The attachment mechanisms 50, 50 are also provided with a biasing mechanism, generally indicated by the numeral 70. As shown, the biasing mechanism 70 is interposed between the gripper assemblies 55 and the fixed knuckles 62. In particular, the biasing mechanism 70 is depicted as a generally U-shaped flat steel spring 71 which has one leg 72 engaging the intermediate leg 56 of gripper assembly 55 and the other leg 73 engaging a reinforcing plate 74 interposed between two adjacent fixed knuckles 62 (see FIGS. 3 and 5). As shown, the reinforcing plates 74 are positioned between the two outer fixed knuckles 62, 62 at lateral extremities of each gripper assembly 55. It will be appreciated that a single medially positioned biasing mechanism 70 could be employed in certain instances as well as additional biasing mechanisms 70 in the event of a gripper assembly 55 of greater lateral dimensions. The biasing mechanism 70 serves to urge the gripper assemblies 55 toward the open position depicted in FIG. 3 of the drawings.

Figure 4:
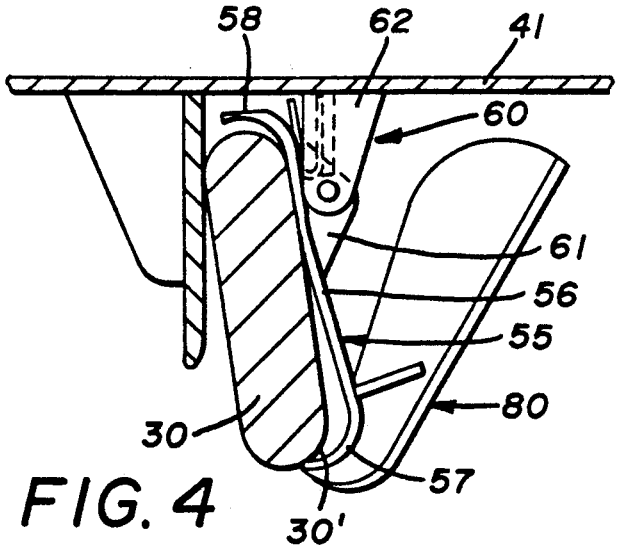
FIG. 4 is a cross-sectional view through the gripper assembly comparable to FIG. 3 which is a sequential view subsequent to FIG. 3 showing the tray displaced further downwardly in effecting attachment.
Figure 5:
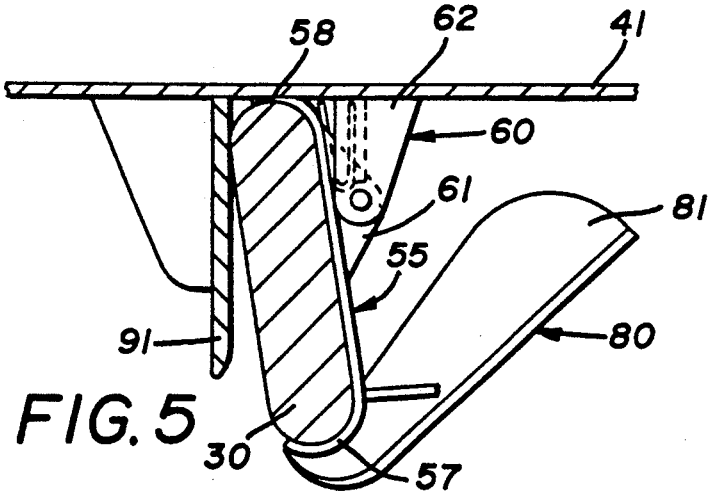
FIG. 5 is a cross-sectional view similar to FIGS. 3 and 4 which is a sequential view subsequent to FIG. 4 showing the gripper assembly in locked position achieved by displacing the tray downwardly from the position depicted in FIG. 4.
Figure 6:
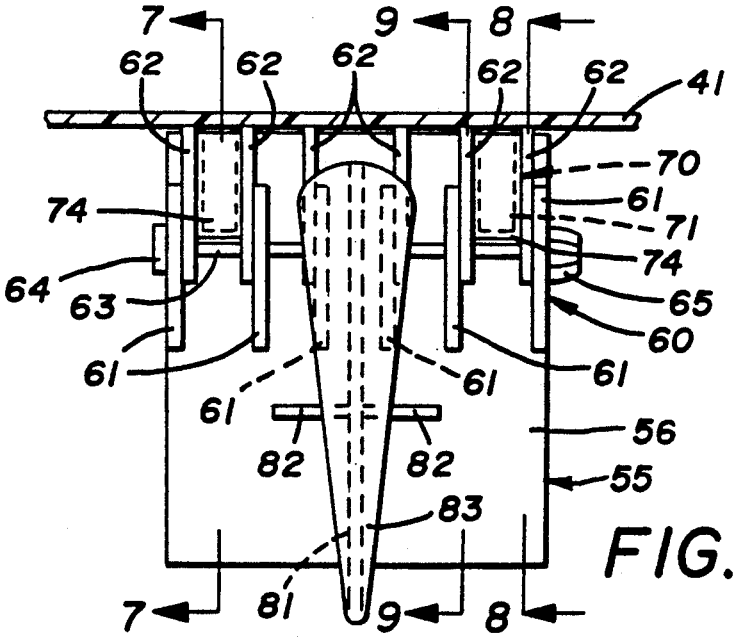
FIG. 6 is a side elevational view of the gripper assembly of FIGS. 2 and 3.
Figure 7:
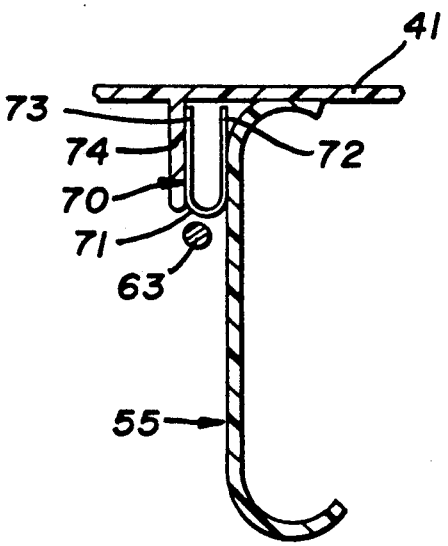
FIG. 7 is a fragmentary sectional view taken substantially along the line 7—7 of FIG. 6 showing details of the spring member.
Figure 8:
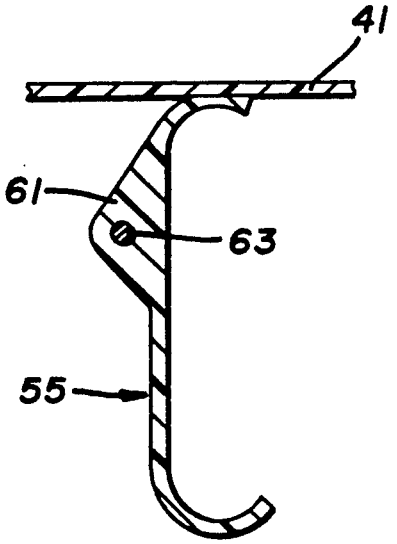
FIG. 8 is a fragmentary sectional view taken substantially along the line 8—8 of FIG. 6 showing details of the movable knuckle of the hinge.

The tray 20 is attached to the high chair 21 by the sequence of operational steps depicted in FIGS. 3-5 of the drawings. In FIG. 3, the tray is brought into proximity to the side rails 30, 31 of the high chair 21. Each of the gripper assemblies 55, 55 is in the open position depicted in FIG. 3 of the drawings due to the operation of the biasing mechanism 70 described above. It is to be noted that with the tray maintained in a substantially level orientation, the tray 20 is guided into the FIG. 3 position by the angled orientation of the intermediate legs 56, 56 of gripper assemblies 55, 55.

Further downward displacement of the tray 20 from the position depicted in FIG. 3 of the drawings tends to flex or bend the gripper assemblies 55, 55 and particularly the intermediate legs 56, 56 thereof as illustrated in FIG. 4 until the projecting leg 57 is displaced around the rounded edge 30' at the lower extremities of side rails 30, 31. Exertion of further downward force on the tray 20 from the position depicted in FIG. 4 results in the upper extremity of the side rails 30, 31 engaging the projecting ends 58, 58 of gripper assemblies 55 and the projecting ends 57, 57 snapping into the locked position depicted in FIG. 5. It will be appreciated that with a gripper assembly 55 positioned to the lateral outside of each of the side rails 30, 31 and each gripper assembly 55, 55 overlying substantially three sides of the side rails 30, 31, the tray 21 is firmly affixed to the high chair 21. Greater structural rigidity and locking integrity may be achieved by the projecting end 58 engaging the surface 41 of tray 20 when the gripper assemblies 55 are in the locked position as shown in FIG. 5 of the drawings.

The removal of the tray 20 from high chair 21 is effected by essentially a reversal of the sequence described for attachment. As will be appreciated, the projecting end 57 must be flexed about the intermediate leg 56 accompanied by a vertical raising of the tray 20 relative to high chair 21 to essentially the position depicted in FIG. 4 of the drawings. Applying further raising force to the tray, with or without flexing of intermediate leg 57, results in release of the side rails 30, 31 by gripper assemblies 55, 55 with the tray 20 achieving a position relative to the side rails 30, 31 as depicted in FIG. 3 of the drawings. At this time, the tray is free to be lifted upwardly and away from high chair 21 as for cleaning.

It will be appreciated by persons skilled in the art that a series of ridges (not shown) could be provided on the surface of intermediate leg 56 engaging side rails 30, 31 if it is desired to facilitate sliding of the tray longitudinally of the rails 30, 31 for adjusting the position of tray 20. A slight flexing of the intermediate leg 56 can serve to facilitate such sliding action. Alternatively, the intermediate legs 56 of gripper assemblies 55 could have the surfaces engaging rails 30, 31 coated or faced with an irregular compressible material in order to increase frictional resistance in the event that sliding of tray 20 longitudinally of rails 30, 31 is not desired.

The flexing of the intermediate legs 56, 56 of grippers 55, 55 for removal of the tray 20 from high chair 21, as described above, can be greatly facilitated by providing a release mechanism, generally indicated by the numeral 80. The release mechanism 80 consists of an arm 81 which extends from projecting end 57 of gripper assembly 55. The arm 81 preferably extends away from and somewhat in the direction of or at an acute angle to intermediate leg 56. The arm 81 may be provided with angle supports 82 (see FIGS. 2 and 6) in order to provide additional strength to the interconnection between arm 81 and the gripper assemblies 55. The arm 81 may also be provided with a contact plate 83 of substantial width in a direction laterally of the gripper assembly 55 in order to facilitate the engagement of and displacement of the arm 81 by the fingers of a person effecting unlocking of the gripper assemblies 55 and removal of tray 20 from high chair 21. As depicted in FIG. 2 of the drawings, the contact plates 83 of arms 81 attached to gripper assemblies 55 are conveniently located proximate the periphery of tray 20 and, in particular, proximate the ridge 45 at the perimeter of body portion 40 of tray 20.

If desired to provide increased resistance to lateral forces which might be applied to the tray 20 while installed on a high chair 21, the tray 20 may be provided with a lateral impact absorber, generally indicated by the numeral 90, which is best seen in FIGS. 2 and 3. As shown, a lateral impact absorber 90 is installed proximate to each of the attachment mechanisms 50. Each lateral impact absorber 90 consists of an inner stop bar 91 which projects downwardly from tray 20 and is spaced a distance laterally inwardly from the proximate attachment mechanism 50 and particularly from the intermediate legs 56, 56 of gripper assemblies 55 in the locked position of FIG. 5 a distance equal to or slightly greater than the thickness of the side rails 30, 31. In this manner, an inner stop bar 91 is positioned just laterally inwardly of each of the rails 30, 31 such that a lateral force imparted to either lateral extremity of tray 20 would be directly transmitted to one of the inner stop bars 91 before an attachment mechanism 50 might be damaged. As shown in FIG. 2, the inner stop bars 91 may extend a substantial distance laterally of the attachment mechanisms 50. In addition, the stop bar may have an extension 92 which projects further downwardly in the area proximate to the attachment mechanisms 50, 50. The inner stop bars 91 may also have spaced reinforcing ribs 93 positioned in the area of the extension 92 or, if desired, along the entire length of the inner stop bars 91.

Figure 10:
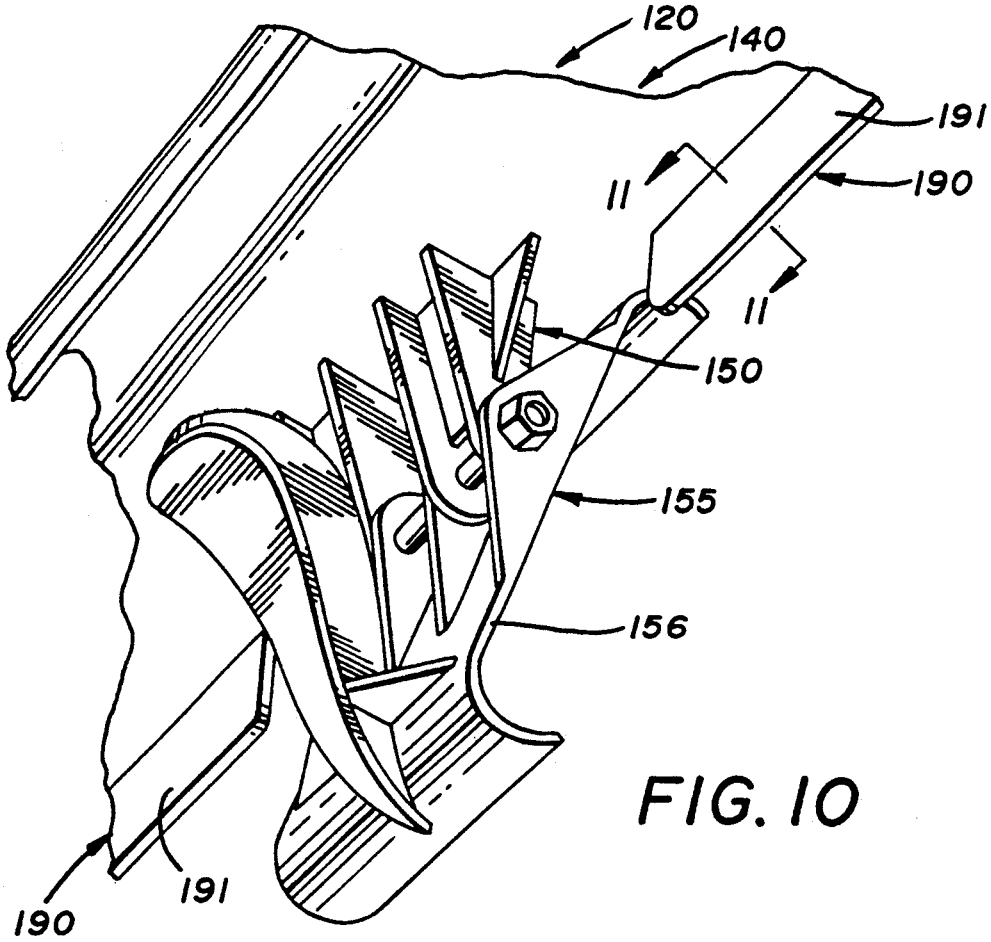
FIG. 10 is a fragmentary perspective view similar to FIG. 2 of a second embodiment of the invention depicting an outer stop bar in lieu of the inner stop bar employed in the first embodiment of the invention.
Figure 11:
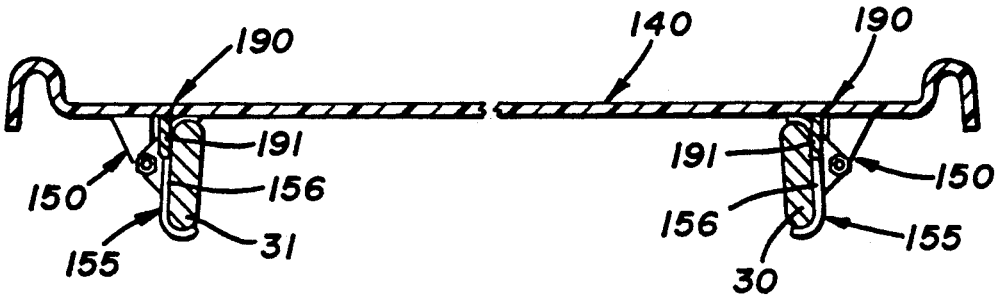
FIG. 11 is a sectional view taken through the tray attachment of the second embodiment of the invention depicting the placement of the outer stop bars shown in FIG. 10 in relation to the side rails of a high chair.

The second embodiment of the invention depicted in FIGS. 10 and 11 of the drawings is identical to the first embodiment in most respects. In particular, the second embodiment includes a detachable tray attachment, generally indicated by the numeral 120, which may be identical to tray 20. Further, the tray 120 has a body portion 140 which may be identical to body portion 40 of tray 20. As further seen particularly in FIG. 10, attachment mechanisms 150, 150, including gripper assemblies 155, 155, are identical to the attachment mechanisms 50, 50 and gripper assemblies 55.

The tray attachment 120 differs from the tray 20 in the structure and positioning of a lateral impact absorber, generally indicated by the numeral 190 in FIGS. 10 and 11 of the drawings. As shown, a lateral impact absorber 190 is installed proximate to each of the attachment mechanisms 150. Each lateral impact absorber 190 consists of an outer stop bar 191 which projects downwardly from tray 20 and is generally aligned with the proximate attachment mechanism 150 and particularly with the intermediate legs 156, 156 of gripper assemblies 155, 155 in the locked position seen in FIG. 11 of the drawings. In this manner, an outer stop bar 191 is positioned just laterally outwardly of each of the rails 30, 31 such that a lateral force imparted to either lateral extremity of tray 120 would be transmitted to one of the outer stop bars 191 before an attachment mechanism 150, 150 might be damaged. As shown in FIG. 10, the outer stop bars 191 preferably extend a distance in either direction from attachment mechanisms 150, 150 and are necessarily discontinuous in the area of the attachment mechanisms 150, 150. The outer stop bars 191, 191 could be provided with ribs or other reinforcing elements comparable to ribs 93 of lateral impact absorber 90.

It is also to be appreciated that a particular attachment tray could employ one or more of the impact absorbers 90, 190 in various combinations and arrangements. For example, either of the attachment assemblies 150, 150 could have an inner stop bar 91 and an outer stop bar 191 located such as to lie laterally inwardly and outwardly in adjacent relation to either of the side rails 30, 31 of a high chair 21. In this manner, protection from lateral forces imparted to either lateral extremity of a tray would similarly be transmitted to one of the stop bars 91, 191.

Thus it should be evident that the high chair tray attachment disclosed herein carries out the various objects of the invention set forth hereinabove and otherwise constitutes an advantageous contribution to the art. As may be apparent to persons skilled in the art, modifications can be made to the preferred embodiment disclosed herein without departing from the spirit of the invention, the scope of the invention being limited solely by the scope of the attached claims.

I claim:

1. Detachable tray apparatus for a high chair having a pair of spaced arm rails comprising, means providing a substantially planar surface spanning the distance between the pair of spaced arm rails and a pair of spaced attachment means affixed to said means providing a substantially planar surface and selectively engaging the arm rails, said attachment means having pivotally mounted gripper means movable from an open position into engagement with a portion of the periphery of an arm rail for maintaining the tray in a locked position, said gripper means having projecting ends for encasing a plurality of sides of an arm rail and having an intermediate leg joining said projecting ends which selectively bends to facilitate bringing said projecting ends into and out of locking engagement with the arm rails.

2. Apparatus according to claim 1, wherein said projecting ends and said intermediate leg overlie substantially three sides of an arm rail.

3. Apparatus according to claim 1, wherein said attachment means includes hinge means pivotally mounting said gripper means.

4. Apparatus according to claim 1, wherein said attachment means are positioned laterally outwardly of the arm rails when the tray is in said locked position.

5. Apparatus according to claim 4, including stop means positioned laterally of at least one of the arm rails for resisting forces applied laterally of the tray.

6. Apparatus according to claim 5, wherein said stop means include a pair of stop bars attached to the underside of said means providing a substantially planar surface, one of said stop bars being positioned laterally inwardly of each of the arm rails when the tray is in said locked position.

7. Apparatus according to claim 5, wherein said stop means include a pair of stop bars attached to the underside of said means providing a substantially planar surface, one of said stop bars being positioned laterally outwardly of each of the arm rails when the tray is in said locked position.

8. Apparatus according to claim 7, wherein said stop bars extend in either direction from and are substantially longitudinally aligned with said attachment means when the tray is in said locked position.

9. Apparatus according to claim 1, wherein said gripper means has release means to facilitate detachment of said gripper means from locking engagement with the arm rails for removal of the tray from a high chair.

10. Apparatus according to claim 9, wherein said release means is an extending arm which is depressed to flex said gripper means for detachment from the arm rails.

11. Apparatus according to claim 10, wherein said gripper means have an intermediate leg joining projecting ends and said arm of said release means is attached proximate one of said projecting ends for flexing said intermediate leg to permit detachment of said gripper means from the arm rails.

12. Apparatus according to claim 10, wherein said gripper means is pivotally mounted such that the combined pivoting and flexing of said gripper means effects attachment and detachment of the tray to the arm rails.

13. Apparatus according to claim 1, wherein one of said projecting ends engages said means providing a substantially planar surface when the tray is in the locked position.

14. Detachable tray apparatus for a high chair having a pair of spaced arm rails comprising, means providing a substantially planar surface spanning the distance between the pair of spaced ar rails and a pair of spaced attachment means affixed to said means providing a substantially planar surface and selectively engaging the arm rails, each of said attachment means having hinge means pivotally mounting gripper means movable from an open position into engagement with a portion of the periphery of an arm rail for effecting alignment and locking engagement with the pair of spaced arm rails, said attachment means having spring means for biasing said gripper means toward said open position.

15. Detachable tray apparatus for a high chair having a pair of spaced arm rails comprising, means providing a substantially planar surface spanning the distance between the pair of spaced arm rails and a pair of spaced attachment means affixed to said means providing a substantially planar surface and selectively engaging the arm rails, each of said attachment means having hinge means pivotally mounting gripper means movable from an open position into engagement with a portion of the periphery of an arm rail for maintaining the tray in a locked position, said hinge means including fixed knuckle means having a bore mounted on the underside of said means providing a substantially planar surface, movable knuckle means having a bore on said gripper means, and pin means interconnecting said bores of said fixed knuckle means and said movable knuckle means, one of said bores of said knuckle means being elongate for providing an extent of lateral movement of said gripper means to accommodate arm rails having differing dimensions and arm rails having different spacing therebetween.

16. Apparatus according to claim 15, wherein spring means biases said gripper means laterally toward engagement with the arm rails.

* * * * *